US012031778B2

(12) United States Patent
Nielsen

(10) Patent No.: US 12,031,778 B2
(45) Date of Patent: Jul. 9, 2024

(54) PLATE-AND-SHELL HEAT EXCHANGER AND A HEAT TRANSFER PLATE FOR A PLATE-AND-SHELL HEAT EXCHANGER

(71) Applicant: Danfoss A/S, Nordborg (DK)

(72) Inventor: Helge Nielsen, Sydals (DK)

(73) Assignee: DANFOSS A/S, Nordborg (DK)

( * ) Notice: Subject to any disclaimer, the term of this patent is extended or adjusted under 35 U.S.C. 154(b) by 88 days.

(21) Appl. No.: 17/090,475

(22) Filed: Nov. 5, 2020

(65) Prior Publication Data

US 2021/0140716 A1 May 13, 2021

(30) Foreign Application Priority Data

Nov. 7, 2019 (DK) ..... PA201901303

(51) Int. Cl.
*F28D 9/00* (2006.01)
*F28F 3/08* (2006.01)

(52) U.S. Cl.
CPC ..... *F28D 9/0006* (2013.01); *F28D 9/0043* (2013.01); *F28F 3/08* (2013.01)

(58) Field of Classification Search
CPC .... F28D 9/0043; F28D 9/0006; F28D 9/0012; F28D 9/0031; F28D 9/0037; F28D 21/0017; F28D 2021/0071; F28D 9/005; F28D 21/0003; F28D 1/03; F28D 1/0308; F28D 1/0325; F28D 1/0333; F28F 9/001; F28F 9/005; F28F 3/042; F28F 3/08; F28F 13/08; F28F 9/0075; F28F 2250/104
USPC ..... 165/166, 167, 170, 157
See application file for complete search history.

(56) References Cited

U.S. PATENT DOCUMENTS 5,988,268 A 11/1999 Usami et al.
6,224,370 B1 * 5/2001 Tomizawa ..... F23C 13/00 165/166
6,318,456 B1 11/2001 Brenner et al.
7,416,018 B2 * 8/2008 Thunwall ..... F28F 3/083 165/178
10,087,813 B2 * 10/2018 Okami ..... F28F 3/12
(Continued)

FOREIGN PATENT DOCUMENTS

CN 104040282 A 9/2014
CN 108474626 A 8/2018
(Continued)

OTHER PUBLICATIONS

Extended European Search Report for European Patent Application No. 20191662.4 dated Dec. 15, 2020.

*Primary Examiner* — Jianying C Atkisson
*Assistant Examiner* — For K Ling
(74) *Attorney, Agent, or Firm* — McCormick, Paulding & Huber PLLC

(57) ABSTRACT

The present invention relates to a plate-and-shell heat exchanger and a heat transfer plate for a plate-and-shell heat exchanger. The heat exchanger comprises a shell and a plurality of heat transfer plates within the shell. The plates form fluidly connected first cavities for providing a first fluid flow path for a first fluid flow. The shell forms a second cavity in which the plates are arranged, and a second fluid flow path is provided for a second fluid flow, separated from the first fluid flow path by the plates. The heat exchanger comprises heat transfer plates which are formed for improving the distribution of the second fluid flow within the heat exchanger.

19 Claims, 5 Drawing Sheets

(56) References Cited

U.S. PATENT DOCUMENTS

| | | | | |
|---|---|---|---|---|
| 2007/0193732 | A1* | 8/2007 | Oofune | F28D 9/0031 165/164 |
| 2011/0120672 | A1* | 5/2011 | Ringwaldt | F28D 3/00 165/104.14 |
| 2018/0356159 | A1* | 12/2018 | Bergh | F28D 9/005 |
| 2018/0363990 | A1 | 12/2018 | Rondet | |

FOREIGN PATENT DOCUMENTS

| | | | | | |
|---|---|---|---|---|---|
| DE | 4313505 | A1 | * | 10/1994 | F28D 9/0043 |
| DE | 202014105819 | U1 | * | 4/2015 | F24H 1/28 |
| EP | 2 361 365 | B1 | | 10/2015 | |
| EP | 3 372 937 | A1 | | 9/2018 | |
| EP | 2 002 193 | B1 | | 11/2018 | |
| EP | 3 489 607 | A1 | | 5/2019 | |
| GB | 668905 | A | | 3/1952 | |
| GB | 2130354 | A | * | 5/1984 | F28D 9/0043 |
| GB | 1042161 | A | | 9/1996 | |
| JP | 2006177637 | A | * | 7/2006 | |
| JP | 2012220118 | A | * | 11/2012 | |
| JP | 2015194324 | A | * | 11/2015 | |
| KR | 10-1891444 | B1 | | 8/2018 | |
| RU | 2 246 673 | C2 | | 2/2005 | |
| RU | 2 282 124 | C2 | | 8/2006 | |

* cited by examiner 100
24
24'
22
11
10
12

22
20
24'
21
22
24
11
10
100
23, 23'
12

100

100

PLATE-AND-SHELL HEAT EXCHANGER AND A HEAT TRANSFER PLATE FOR A PLATE-AND-SHELL HEAT EXCHANGER

CROSS-REFERENCE TO RELATED APPLICATION

This application claims foreign priority benefits under 35 U.S.C. § 119 to Danish Patent Application No. PA201901303 filed on Nov. 7, 2019, the content of which is hereby incorporated by reference in its entirety.

TECHNICAL FIELD

The present invention relates to a plate-and-shell heat exchanger and a heat transfer plate for a plate-and-shell heat exchanger.

BACKGROUND

Plate-and-shell heat exchangers comprise a plurality of stacked structured plates positioned within a shell or casing. The plates are connected in pairs such that a first fluid flow path for a first fluid is provided at least partially within the connected pairs of plates. The pairs of connected plates are designed to fluidly connect a first inlet opening to a first outlet opening of the heat exchanger, thereby forming the first fluid flow path. A second fluid flow path for a second fluid is provided outside of the connected pairs of plates and separated from the first fluid flow path by the plates. The second fluid flow path fluidly connects a second inlet opening to a second outlet opening.

The second fluid enters the shell of the heat exchanger through the second inlet opening, flows along the complex second fluid flow path inside the shell and out through the second outlet opening. As the second fluid enters the shell of the heat exchanger it undergoes a complex change from a tubular or cylindrical flow through e.g. a pipe into a branched flow past the various components of the inside of the heat exchanger.

Depending on the inside layout of the heat exchanger, the second fluid flow may be obstructed in some regions and/or guided in a non-uniform way, such that the heat transfer rate between the two fluids inside the heat exchanger is reduced. The present invention's goal is therefore to enhance the heat exchanger efficiency. This includes ensuring a symmetric flow distributing at both the shell side and the cassette side. A further object is to ensure optimal relations between pressure drop and pressure distribution at the both sides and increase heat distribution. Further, an object is to make a more robust heat exchanger to high pressures with even distribution over the outer parts enabling reinforcements close to the centre. In the present context 'shell side' refers to the flow path where the inside of the shell forms the distribution of the flow inlet and outlets by the sides of the heat transfer plates, and the cassette side refers to the connected and sealed flow paths formed by the connected plates themselves with inlet and outlet by the openings formed in the heat transfer plates.

SUMMARY

This goal is achieved by the present invention's heat exchanger according to claim 1 and by a heat transfer plate for a heat exchanger according to claim 10. Further embodiments of the invention are subject of the dependent claims.

According to the first claim, a plate-and-shell heat exchanger is provided, which comprises a shell and a plurality of heat transfer plates within the shell. The shell may be of a cylindrical form and the heat transfer plates may be sized and formed to fit snugly into the shell. However, non-cylindrical shapes of the shell are also possible. The heat transfer plates form fluidly connected first cavities for providing a first fluid flow path for a first fluid flow. The shell forms a second cavity in which the plates are arranged and in which a second fluid flow path for a second fluid flow is provided. The second fluid flow paths is fluidly separated from the first fluid flow path by the plates. The first fluid flow path leads through inlet and outlet plate openings between adjacent plates, forming the cassette side, and the second fluid flow path leads through second inlet and outlet openings of the shell, forming the shell side. At least some of the plates comprise at least one recess in proximity of one plate opening and the second inlet or outlet opening. At least some the plates are symmetric along a cross sectional line of the heat exchanger extending orthogonal to a cross sectional line reaching from inlet to outlet plate openings. The heat exchanger is designed such that the recess, one plate opening and the second inlet or outlet opening may be positioned in one sector of the heat exchanger, which is separated from other sectors of the heat exchanger containing other recesses, the other plate opening and/or the other second opening.

Providing the recess, one of the plate openings and either of the second openings in the same sector makes it possible to create a distribution chamber within the shell, which facilitates an optimized distribution of the second fluid within the second cavity. The heat exchanger therefore comprises heat transfer plates which are formed for improving the distribution of the second fluid flow within the heat exchanger. Although the heat exchange surface of the recessed heat transfer plates is reduced compared to plates which comprise no such recess, the overall efficiency of the heat exchanger may be enhanced due to better distribution of the second fluid flow.

As a plurality of heat transfer plates is usually employed within the heat exchanger, an according number of recessed plates may be provided in the heat exchanger. The plates may be identical to each other, with respect to the shapes of their recesses. Or, alternatively, the shapes of the recesses may vary at some plates. In particular, the recesses of plates positioned further away from the second inlet and outlet opening may be smaller or larger than the recesses of plates positioned closer to the second inlet and outlet openings.

The term recess may be understood in a broad sense, referring to any curved, straight or combined curved and straight section of the plate. As the plate may usually be based on a circular shape, the recess may refer to any marginal portion of the plate which represents a deviation from the otherwise circular shape of the plate.

In a embodiment of the invention at least some of the plates comprise two recesses close to one plate opening and the second inlet or outlet opening. The two recesses may be symmetrical to each other. This definition of the positioning and the shape of the recesses relates to a cross-sectional view or cross-sectional plane of the heat exchanger, as will be more evident from the description of the figures. The presence of two recesses close to one plate opening and the second openings makes it possible to maximize the volume of the distribution chamber and thereby to optimize the distribution of the second fluid flow.

In another embodiment of the invention at least some of the plates comprise four recesses, two of which are close to the inlet plate opening and two of which are close to the outlet plate opening. Again, the positioning of the recesses relates to a cross-sectional view or plane of the heat exchanger. Independently of the number and positioning of the recesses, the plates of one heat exchanger may be identical to each other or at least some of the plates of one heat exchanger may have different numbers, shapes and/or positions of their respective recesses.

In another p embodiment of the invention two recesses, one plate opening and the second inlet opening or the second outlet opening are positioned in one distribution section of the heat exchanger, said distribution section corresponding to a section of the heat exchanger which spans an angle smaller than 120°, in particular smaller than 90° and preferably smaller than 85° in a cross-sectional view or plane of the heat exchanger. The terms section or distribution section of the heat exchanger as presently used may refer to a sector or wedge-shaped cut out from a cylindrically shaped heat exchanger. The section may therefore correspond to a portion of the heat exchanger which resembles a partial cylinder limited by two planes crossing each other at a centre line of the heat exchanger.

In another embodiment of the invention the heat exchanger comprises two distribution sections offset from each other by 180° and preferably separated from each other by guiding sections, said guiding sections preferably comprising curved outer portions, which align with an inner wall of the shell. The distribution sections are defined by the presence of the recess in the close vicinity of a plate opening and of a second opening.

In another embodiment of the invention the recess comprises at least one straight portion and/or at least one concave curved portion and/or at least one convex curved portion. The precise shape of the recess may be adapter to the overall geometry of the heat exchanger and for maximizing the distribution of the second fluid flow within the distribution chamber defined at least partially by the shape of the recess.

In another embodiment of the invention two recesses are provided and designed to form a distribution chamber of a u-shaped cross section. A u-shaped distribution chamber makes it possible to position the plate openings at least partially surrounded by the distribution chamber. This yields a design which makes it possible to distribute the second fluid more efficiently between the heat transfer plates of the heat exchanger while at the same time maintaining the size and therefore the heat transfer surface of the heat transfer plates as large as possible. In effect, the overall efficiency of the heat exchanger is increased.

In another embodiment of the invention the height of the distribution chamber is smaller than twice the height of the plate openings, in particular less than one and a half times the height of the plate openings and preferably about the same as the height of the plate openings. The height of the plate opening may be understood as its inner diameter in case of a circular plate opening. If the plate opening is not circular, its greatest or smallest inner width in a cross-sectional plane or its clearance in the direction defined by the second openings may correspond to the height of the plate opening. The direction defined by the second openings may correspond to the height of the heat exchanger as will be shown in the figures.

In another embodiment of the invention the plate is symmetrical about two axes in a cross-sectional view or plane of the heat exchanger. As the fluid flowing through the heat exchanger may at least partially display symmetrical path characteristics, a correspondingly symmetrical layout of the plate can further increase the overall efficiency of the heat exchanger. The plate may be symmetrical about the two axes being respectively the cross sectional line of the heat exchanger extending orthogonal to a cross sectional line reaching from inlet to outlet openings, and about said line reaching from inlet to outlet openings.

The recessed plates may interconnect in pairs at their outer rim.

The plates may be positioned symmetrically within the shell such that the two distribution chambers formed by the recesses are of equal size and shape. This gives an especially strong heat exchanger to high pressures. The symmetric positioning enables more event distribution of the flows, and with shells being e.g. circular or oval, the shell wall curvature assists in keeping the stack of heat transfer plates in position despite the flows and pressures. The present invention also relates to a heat transfer plate for a plate-and-shell heat exchanger according to any of the embodiment heat transfer plates. The heat transfer plate may feature any of or all the characteristics described above with respect to the heat exchanger and the corresponding heat transfer plate.

BRIEF DESCRIPTION OF THE DRAWINGS

Further details and advantages of the invention are described with reference to the following figures.

DETAILED DESCRIPTION

Figures 1A, 1B:
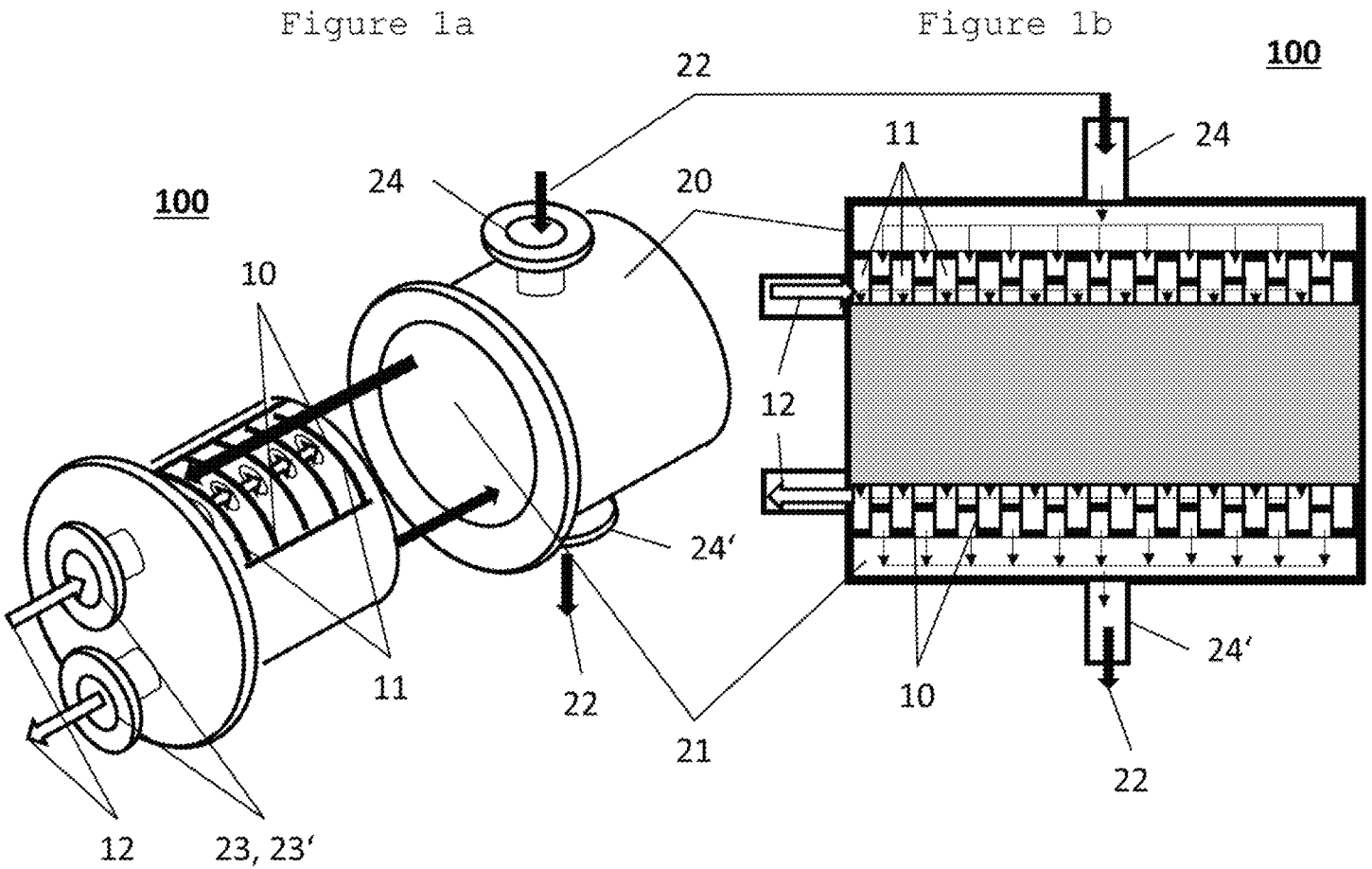
FIG. 1*a*: an exploded view of a plate-and-shell heat exchanger.
FIG. 1*b*: a sectional schematic view of a plate-and-shell heat exchanger.

FIG. 1*a* shows an exploded view of a plate-and-shell heat exchanger 100. The heat exchanger 100 comprises a shell 20 and a plurality of sealed pairs of heat transfer plates 10 within the shell 20.

The shell 20 may be of a hollow cylindrical shape and the plates 10 may be of a corresponding shape and size such that they can be fit into the shell 20. Other shapes of the shell 20 and plates 10 are also possible, however shapes are preferred, which at least partially allow for close positioning of the plates 10 to the shell 20.

The plates 10 form fluidly connected first cavities 11 for providing a first fluid flow path 12 for a first fluid flow indicated by the corresponding arrows. The first fluid flow enters and leaves the heat exchanger 100 through first inlet and outlet openings 23, 23'. The first cavities 11 are surrounded by two adjacent plates 10, which are connected to each other, as is shown more clearly in FIG. 1*b* and as will be described below in more detail. FIG. 1*b* shows the heat exchanger 100 in a sectional view and in an assembled state.

The plates 10 are welded or brazed at their rims in pairs, two and two, forming first cavities 11 for a sealed first fluid flow path 12 from a first inlet opening 23 to a first outlet opening 23'. A plurality of such stacks are stacked and welded or brazed around the first inlet and outlet openings 23, 23'. The connected first inlet and outlet openings 23, 23' form hollow volumes such as e.g. hollow cylinders reaching through the stack to distribute and circulate a first fluid along the sealed first fluid flow path 12. The second fluid flow path 22 formed outside of the sealed pairs of plates 10 and inside of the shell 20 is connected to second inlet and outlet openings 24, 24'. A second fluid flow enters and leaves the heat exchanger 100 through second inlet and outlet openings 24, 24'.

The shell 20 forms a second cavity 21 in which the plates 10 are arranged and in which a second fluid flow path 22 for a second fluid flow is provided. The second fluid flow enters and leaves the heat exchanger 100 through second inlet and outlet openings 24, 24'. The second fluid flow path 22 is separated from the first fluid flow path 12 by the plates 10. The heat exchange occurs between the two fluids flowing separated from each other by the plates 10.

Figure 2B:
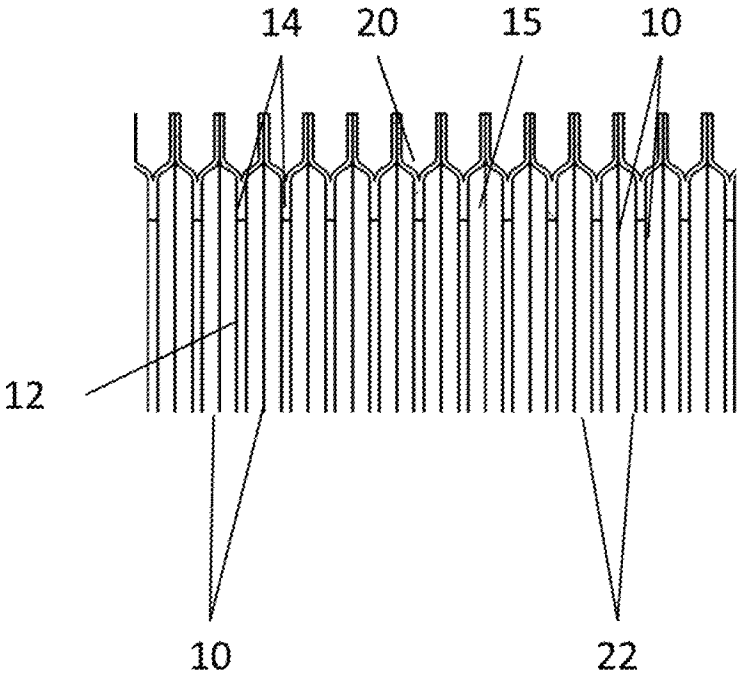
FIG. 2*b*: a detailed sectional view of a plurality of connected heat transfer plates.
Figure 2A:
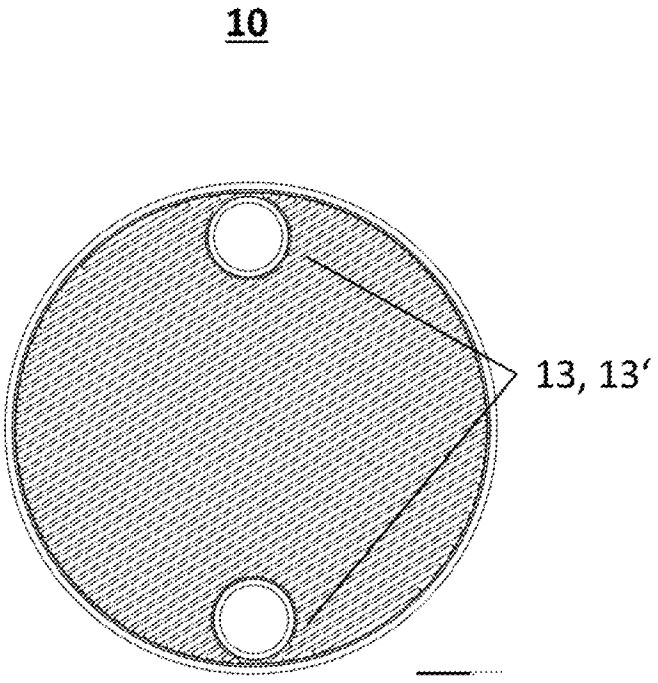
FIG. 2*a*: a detailed view of a heat transfer plate of a plate-and-shell heat exchanger.

FIG. 2*a* shows a detailed view of a heat transfer plate 10 as known in the art. The plate 10 may comprise a circular sheet metal and may comprise bent or otherwise non-planar portions. The plate 10 may separate the first fluid flow path 12 on one side of the plate 10 from the second fluid flow path 22 on the other side of the plate 10. The plate 10 may comprise patterned heat transfer sections on one or on both sides of its generally planar and/or circular sides. The patterned heat transfer sections may be patterned for increasing the contact surface between the plate 10 and the fluids flowing past the plate 10, thereby increasing the heat transfer through the plates 10 and between the fluids. The patterned heat transfer sections may include a mesh and/or stamped and/or die-cut and/or deep-drawn portions.

The plates 10 may comprise plate openings 13, 13' for connecting fluidly adjacent plates 10 to each other and to the first inlet and outlet opening 23, 23' shown in FIG. 1*a*. Two adjacent plates 10 may be connected and sealed together by a welding or brazing along the edge of the plate openings 13, 13' and/or along the outer perimeter of the two plates 10.

Figure 4:
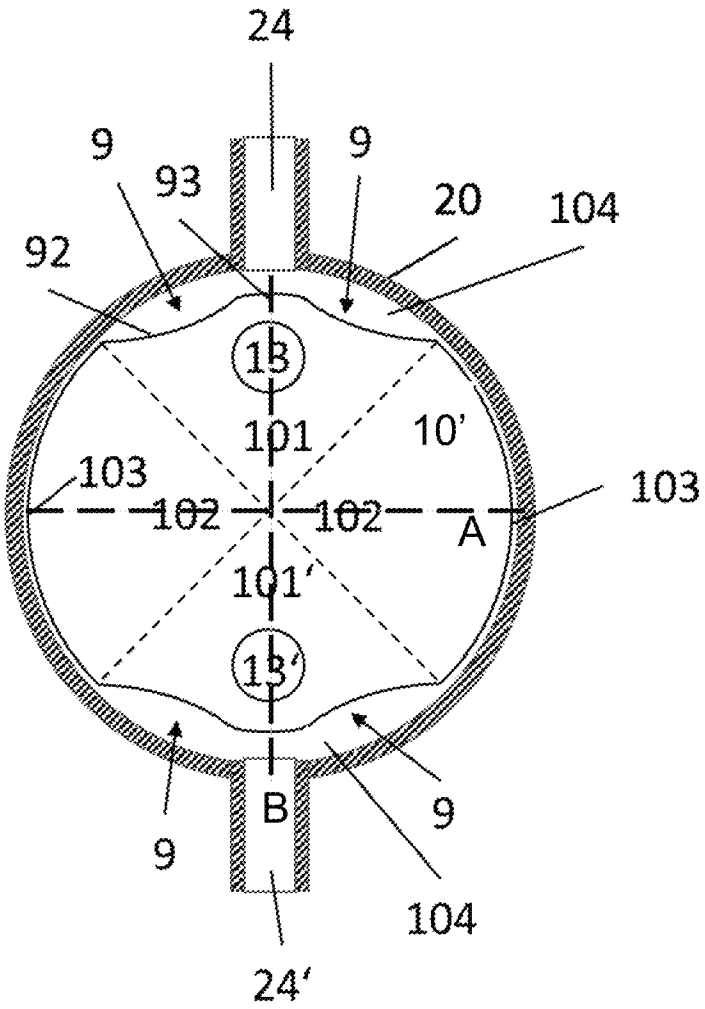
FIG. 4: a sectional view of a heat exchanger with a recessed heat transfer plate.
Figure 5:
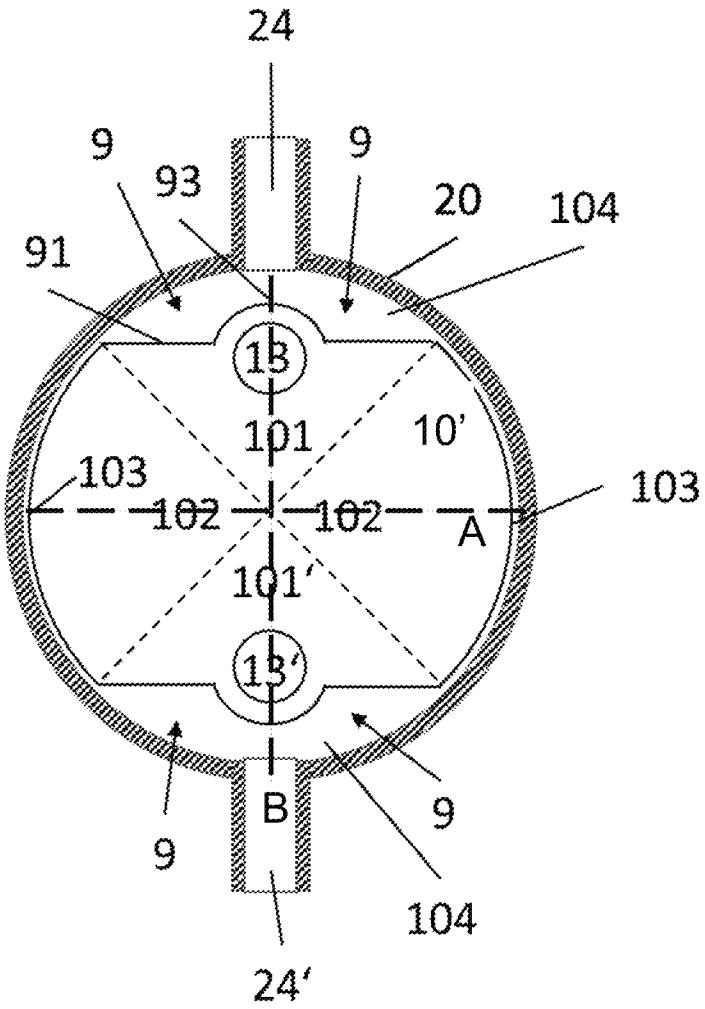
FIG. 5: a sectional view of another embodiment of a heat exchanger with a recessed heat transfer plate.

In contrast to the plate 10 shown in FIG. 2*a* the plates 10 according to the invention have an at least partially non-circular outer perimeter, as will be shown in FIGS. 4 and 5.

FIG. 2*b* shows a detailed sectional view of a plurality of connected heat transfer plates 10. Two adjacent plates 10 may be connected to each other at their outer circumferences, in particular at annular connection portions 14 of their outer edges. Thus, sealed pairs of connected plates 10 are provided for allowing the first fluid to flow through the first fluid flow path 12 bounded by the connected pairs of plates 10.

The second fluid flow path 22 is guided between two adjacent pairs of connected plates 10 and separated from the first fluid flow path 12 by the plates 10 it passes. The second fluid flow path 22 comprises flat, narrow channels between closely positioned plates 10. For efficient heat exchange, the second fluid flow rate in the vertical direction and between the pairs of connected plates 10 as shown in FIG. 2*b* is essential. This flow component corresponds in approximation to a radial or tangential component of the second fluid flow with respect to the shell 20.

As can be seen in FIG. 2*b*, in the area of the annular portions 14 of the plates 10, the second fluid needs to flow in a horizontal direction of FIG. 2*b* to be distributed between the various pairs of connected plates 10.

This horizontal or axial component of the second fluid flow may be limited by the space available between the plates 10 and the inner wall of the shell 20. Accordingly, the heat transfer rate between the two fluids may be adversely affected by a lack of space between the plates 10 and the inner wall of the shell 20.

Figure 3:
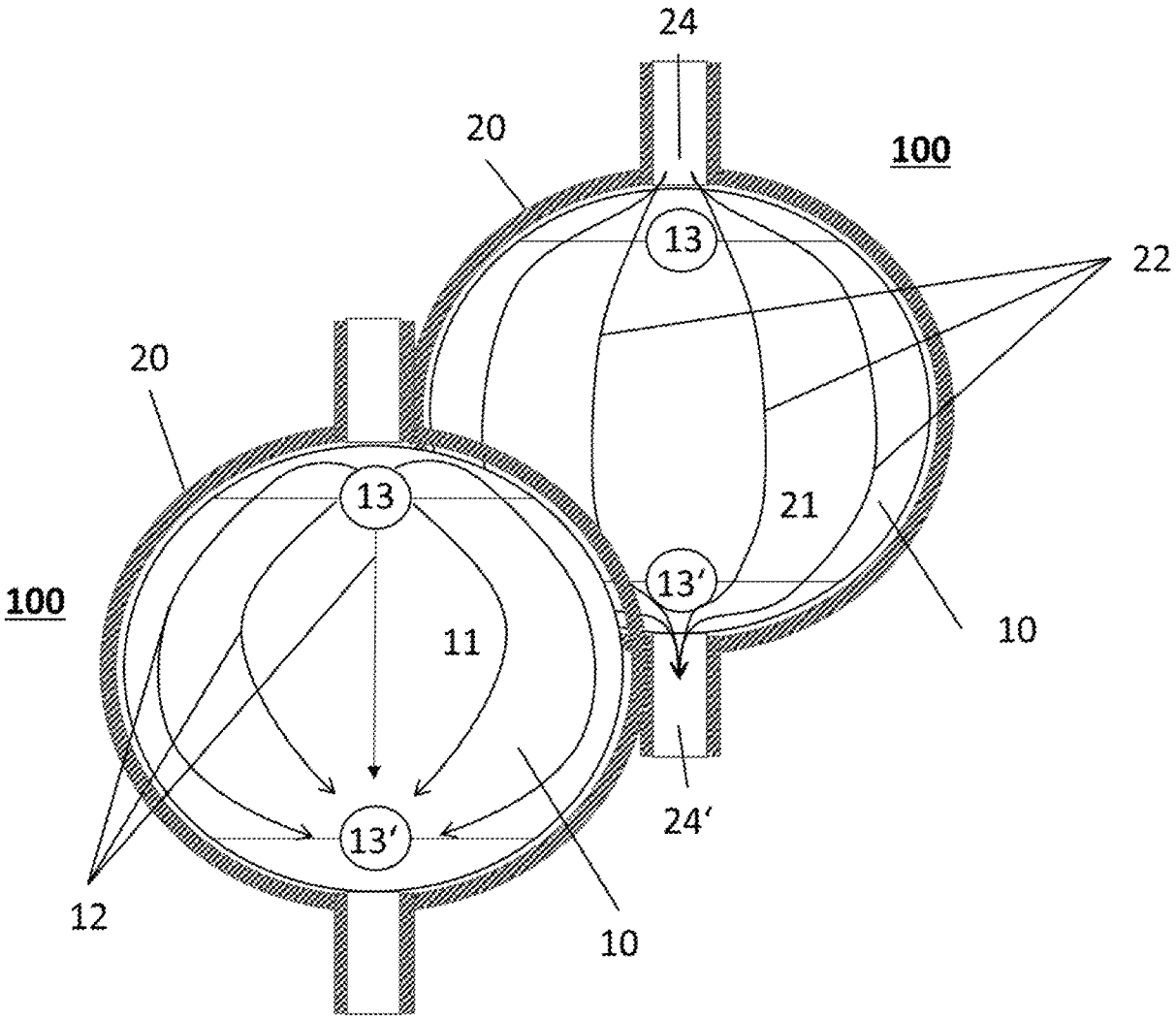
FIG. 3: a schematic view of a first and second fluid flow path through the heat exchanger.

FIG. 3 is a schematic view of a first and second fluid flow paths 12, 22 through the heat exchanger 100. Cross sections of the heat exchanger 100 perpendicular to the longitudinal axis of the shell 20 are shown next to each other in FIG. 3. The left image shows a cross-section of the heat exchanger 100 at a longitudinal position which corresponds to the position of a pair of connected heat transfer plates 10. The left image therefore shows the inside of a pair of connected heat transfer plates 10, that is the inside of a first cavity 11. The first fluid flow path 12 is indicated by the arrows. Inside the cavity 11, the first fluid flow path 12 leads from the inlet plate opening 13 to the outlet plate opening 13'. In between the two openings 13, 13', the first fluid fills the entire first cavity 11 such that heat transfer can occur over the entire or almost entire surface of the pair of connected plates 10. The heat transfer between the first fluid in the first cavity 11 and the second fluid outside the first cavity 11 is hence facilitated. Inside the sealed pair of plates 10, the edges of the two connected plates 10 are welded or brazed or otherwise connected.

The right image shows a cross-section of the heat exchanger 100 at a longitudinal position which corresponds to the position of a gap between two pairs of connected heat transfer plates 10. The right image therefore shows the inside of the second cavity 21, which is separated from the first cavity 11 by the walls of the heat transfer plates 10. The second cavity 21 contains parts of the second fluid flow path 22, as indicated by the corresponding arrows. The cross section of the right image is therefore off-set with respect to the cross-section of the left image in an axial or longitudinal direction of the shell 20. The two openings 13, 13' shown in the right image connect two neighbouring pairs of connected plates 10 and are part of the first fluid flow path 12 passing there through.

Inside the second cavity 21 the second fluid flow paths 22 leads from the second inlet opening 24 to the second outlet opening 24'. As can be seen in the upper portion of the right image, the second fluid flow path 22 needs to spread out upon entering the inside of the shell 20, in order for it to be distributed more evenly between adjacent heat transfer plates 10. Before leaving the shell 20, the second fluid flow path 22 needs to converge such that it can stream out of the shell 20 through the second outlet opening 24'. Depending on the precise geometry of the heat exchanger 100, the spreading out and convergence of the second fluid flow paths 22 may influence the efficiency of the heat exchanger 100. The present invention may facilitate both, the spreading out and the convergence of the second fluid flow path 22 within the second cavity 21.

The second fluid flow path 22 fills the second cavity 21. The second cavity 21 is bounded by the inside of the shell 20, the outsides of the pairs of connected plates 10, one of which is shown in the right image, and possibly further structures contained within the shell 20. The second flow path 22 enters the shell 20 through the second inlet and outlet openings 24, 24', which may be positioned on opposite sides of the shell surface.

FIG. 4 shows one embodiment of the present invention's solution for spreading out and converging the second fluid flow path 22 more effectively. The plate 10' of the heat exchanger 100 comprises four recesses 9. Two of the recesses 9 are close to the inlet plate opening 13 and the other two recesses 9 are close to the outlet plate opening 13'. The heat exchanger 100 is designed such that the recesses 9 close to the inlet plate opening 13 are also close to the second inlet opening 24 and the recesses 9 close to the outlet plate opening 13' are also close to the second outlet opening 24'. The second inlet opening 24 defines an upper side of the heat exchanger 100 and the second outlet opening 24' defines a lower side of the heat exchanger 100. A different embodiment not shown in the figures might comprise only one single recess 9 close to the upper side of the heat exchanger 100 and only one single recess 9 close to the lower side of the heat exchanger 100.

The two recesses 9 on the upper side of the heat exchanger 100, the inlet plate opening 13 and the second inlet opening 24 are positioned in a first distribution section 101 of the plate 10. The first distribution section 101 corresponds to a section of the heat exchanger which spans an angle smaller than about 90° of the cross-sectional view or plane of the heat exchanger 100 with respect to its central axis. The first distribution section 101 and a second distribution section 101' are indicated by dashed lines on the heat transfer plate 10'.

The two distribution sections 101, 101' correspond broadly to the portions of the second fluid flow path 22 shown in FIG. 3, which diverge upon entering the shell 20 and converge prior to leaving the shell 20. The two distribution sections 101, 101' are offset from each other by about 180° with respect to a centreline of the heat exchanger 100. The centreline or central axis of the heat exchanger 100 is positioned at or close to the intersection of the dashed lines and is perpendicular to the drawing plane. The centreline corresponds to the axial direction of the heat exchanger 100.

The two distribution sections 101, 101' are separated from each other by two guiding sections 102. Unlike the distribution sections 101, 101', the guiding sections 102 comprise a radially outward outer portion 103 shaped as a circular line. The outer portions 103 of the guiding sections 102 are formed to fit close to the neighbouring inside of the shell 20.

In the following, the recess 9 located on the top left side will be described more closely. It is understood that some or all the recesses 9 of the heat exchanger may feature the mentioned characteristics. The recess 9 may comprise a concave curved portion 92. The concave curved portion 92 allows for an improved distribution of the second flow in between the pairs of connected heat transfer plates 10' while at the same time maintaining a large surface area of the plates 10'. Additionally, a convex curved portion 93 may be provided at a position above or below either of the inlet or outlet plate openings 13, 13'. Two neighbouring concave curved portions 92 may be connected to each other by one or more convex curved portions 93.

The recesses 9 and the inner side of the shell 20 define a distribution chamber 104. The distribution chamber 104 can be u-shaped, the flanks of the u-shape being defined by the recess 9 and the inside of the shell 20. The portion connecting the flanks of the u-shape may be defined by the inside of the shell 20 and a portion of the plate 10 connecting the two recesses 9. The distribution chamber 104 functions as a connection volume between the second inlet and outlet openings 24, 24' on the one side and, on the other side, the part of the second cavity 21 which is situated between the heat transfer plates 10'. In flowing through the distribution chamber 104 the second fluid is diverged and converged more smoothly when it enters and leaves the second cavity 21. The height of the distribution chamber 104, i.e. its extent in the vertical direction in FIG. 4, is smaller than twice the height of the plate openings 13, 13'.

FIG. 5 shows another embodiment of the invention, in which like features are indicated by like numerals. The major difference between the embodiment of FIG. 5 and the embodiment of FIG. 4 is that the recess 9 comprises one straight portion 91 and no concave curved portion 92. Two adjacent straight portions 91 may be connected by one or more convex curved portions 93. The convex curved portion 93 of FIG. 5 forms a semicircle or almost a semicircle around the plate openings 13, 13'. The straight portions 91 may be all parallel to each other. In all embodiments, the plates 10' of the heat exchanger 100 may be symmetrical about two axes in the cross-sectional views shown in FIGS. 4 and 5.

As illustrated in the recessed embodiments of FIGS. 4 and 5, the heat transfer plates 10' may be symmetric along a cross sectional line (A) of the heat exchanger extending orthogonal to a cross sectional line (B) reaching from inlet to outlet plate openings (13, 13'). The plates (10') may even be symmetrical about the two axes being respectively the cross sectional line (A) of the heat exchanger extending orthogonal to a cross sectional line reaching from inlet to outlet openings (13, 13'), and about said line (B) reaching from inlet to outlet openings (13, 13').

As further illustrated in the recessed embodiments of FIGS. 4 and 5, the heat transfer plates 10' may be positioned symmetrically within the shell 20 such that the two distribution chambers 104 formed by the recesses 9 are of equal size and shape. This gives an especially strong heat exchanger to high pressures. The symmetric positioning enables more event distribution of the flows, and with shells 20 being e.g. circular or oval, the shell wall curvature assists in keeping the stack of heat transfer plates in position despite the flows and pressures.

The invention is not limited to the above-mentioned embodiments but may be varied in manifold ways. Features of the above-mentioned embodiments may be combined in any logically possible manner. All features and advantages including construction details and spatial configurations, which are disclosed in the claims, in the description and in the figures, may be essential to the invention, both, individually and in combination with each other.

What is claimed is:

1. A plate-and-shell heat exchanger comprising a shell and a plurality of heat transfer plates within the shell, said plates forming fluidly connected first cavities for providing a first fluid flow path for a first fluid flow and the shell forming a second cavity in which the plates are arranged and providing a second fluid flow path for a second fluid flow separated from the first fluid flow path by the plates, wherein the first fluid flow path leads through inlet and outlet plate openings between adjacent plates and the second fluid flow path leads through second inlet and outlet openings of the shell, wherein the inlet plate opening and the second inlet opening are located at a first end of the heat exchanger and wherein the outlet plate opening and the second outlet opening are located at a second end of the heat exchanger, wherein at least some of the plates comprise one or more inlet recesses located between the inlet plate opening and the second inlet opening and comprise one or more outlet recesses located between the outlet plate opening and the second outlet opening, and wherein the plates are symmetric about a cross sectional line of the heat exchanger extending orthogonal to a cross sectional line reaching from the inlet to outlet plate openings, wherein the one or more inlet and outlet recesses form distribution chambers having a length measured along a cross sectional line of the heat exchanger extending orthogonal to the cross sectional line reaching from the inlet to outlet plate openings, and wherein the distribution chambers have a maximum length that is less than a maximum width of the plates measured along the cross sectional line of the heat exchanger extending orthogonal to the cross sectional line reaching from the inlet to outlet plate openings.

2. The plate-and-shell heat exchanger according to claim 1, wherein at least some of the plates comprise two of the recesses close to one of the inlet or outlet plate openings and the second inlet or outlet opening.

3. The plate-and-shell heat exchanger according to claim 1, wherein at least some of the plates comprise two inlet recesses and two outlet recesses.

4. The plate-and-shell heat exchanger according to claim 1, wherein two inlet recesses and the second inlet opening are positioned in one distribution chamber of the heat exchanger, said distribution chamber extending along a section of the heat exchanger which spans an angle smaller than 120°, wherein the angle is measured from the intersection of the cross sectional line extending orthogonal to the cross sectional line reaching from the inlet to outlet plate openings and the cross sectional line reaching from the inlet to outlet plate openings in a cross-sectional view of the heat exchanger.

5. The plate-and-shell heat exchanger according to claim 4, comprising two distribution sections offset from each other by 180° and separated from each other by guiding sections, said guiding sections comprising curved outer portions, which align with an inner wall of the shell.

6. The plate-and-shell heat exchanger according to claim 1, wherein at least one of the inlet and/or outlet recesses comprise at least one straight portion and/or at least one concave curved portion and/or at least one convex curved portion.

7. The plate-and-shell heat exchanger according to claim 1, wherein at least two inlet and/or two outlet recesses are provided and designed to form one or more of the distribution chambers of a u-shaped cross section.

8. The plate-and-shell heat exchanger according to claim 7, wherein the height of the distribution chamber measured from the plates to the shell is smaller than twice the height of the plate openings.

9. The plate-and-shell heat exchanger according to claim 1, wherein the plates are symmetrical about two axes in a cross-sectional view of the heat exchanger.

10. The plate-and-shell heat exchanger according to claim 9, wherein the plates are symmetrical about the two axes being respectively the cross sectional line of the heat exchanger extending orthogonal to the cross sectional line reaching from the inlet to outlet openings, and about said line reaching from the inlet to outlet openings.

11. The plate-and-shell heat exchanger according to claim 1, wherein the plates are interconnected in pairs at their outer rim.

12. The plate-and-shell heat exchanger according to claim 1, wherein the at least some of the plates comprising the one or more inlet recesses and the one or more outlet recesses are positioned symmetrically within the shell such that two distribution chambers formed by the inlet and outlet recesses are of equal size and shape.

13. A heat transfer plate for a plate-and-shell heat exchanger according to claim 1.

14. The plate-and-shell heat exchanger according to claim 3, wherein the two inlet recesses partially surround the inlet plate opening and the two outlet recesses partially surround the outlet plate opening.

15. The plate-and-shell heat exchanger according to claim 2, wherein two inlet recesses and the second inlet opening are positioned in one distribution chamber of the heat exchanger, said distribution chamber extending along a section of the heat exchanger which spans an angle smaller than 120°, wherein the angle is measured from the intersection of the cross sectional line extending orthogonal to the cross sectional line reaching from the inlet to outlet plate openings and the cross sectional line reaching from the inlet to outlet plate openings in a cross-sectional view of the heat exchanger.

16. The plate-and-shell heat exchanger according to claim 3, wherein two inlet recesses and the second inlet opening are positioned in one distribution chamber of the heat exchanger, said distribution chamber extending along a section of the heat exchanger which spans an angle smaller than 120°, wherein the angle is measured from the intersection of the cross sectional line extending orthogonal to the cross sectional line reaching from the inlet to outlet plate openings and the cross sectional line reaching from the inlet to outlet plate openings in a cross-sectional view of the heat exchanger.

17. The plate-and-shell heat exchanger according to claim 1, wherein the plurality of heat transfer plates forms a stack of plates, wherein a closer plate in the stack is located closer to the second inlet opening and/or second outlet opening than a farther plate in the stack, and wherein the one or more recesses in the closer plate are larger than the one or more recesses of the farther plate.

18. A plate-and-shell heat exchanger comprising a shell and a plurality of heat transfer plates within the shell, said plates forming fluidly connected first cavities for providing a first fluid flow path for a first fluid flow and the shell forming a second cavity in which the plates are arranged and providing a second fluid flow path from a first end of the heat exchanger to a second end of the heat exchanger for a second fluid flow separated from the first fluid flow path by the plates, wherein the first fluid flow path leads through inlet and outlet plate openings between adjacent plates and the second fluid flow path leads through second inlet and outlet openings of the shell, wherein at least some of the plates comprise at least one recess located between one of the inlet and outlet plate openings and one of the second inlet or outlet openings of the shell, wherein the one of the inlet and outlet plate openings and the one of the second inlet or outlet openings of the shell are located at the same end of the heat exchanger, wherein the plurality of heat transfer plates forms a stack of plates, wherein a closer plate the in the stack is located closer to the second inlet opening and/or the second outlet opening than a farther plate in the stack, and wherein the closer plate has a recess that is larger than a recess of the farther plate, and wherein the plates are not identically shaped.

19. The plate-and-shell heat exchanger according to claim 18, wherein the recesses form a distribution chamber having a length measured along a cross sectional line of the heat exchanger extending orthogonal to the cross sectional line reaching from the inlet to the outlet plate openings, and wherein the distribution chamber has a maximum length that is less than a maximum width of the plates measured along a cross sectional line of the heat exchanger extending orthogonal to the cross sectional line reaching from the inlet to the outlet plate openings.

* * * * *